US008540337B2

(12) United States Patent
Imoto et al.

(10) Patent No.: US 8,540,337 B2
(45) Date of Patent: Sep. 24, 2013

(54) IMAGE FORMING APPARATUS AND FOAM APPLICATION DEVICE

(75) Inventors: Shinji Imoto, Tokyo (JP); Kazuyoshi Matsumoto, Tokyo (JP); Minori Ichimura, Tokyo (JP); Manabu Izumikawa, Tokyo (JP); Yasuhisa Kato, Kanagawa (JP); Yasuo Katano, Kanagawa (JP); Seiji Hoshino, Kanagawa (JP); Masaaki Tsuda, Kanagawa (JP)

(73) Assignee: Ricoh Company, Tokyo (JP)

( * ) Notice: Subject to any disclaimer, the term of this patent is extended or adjusted under 35 U.S.C. 154(b) by 295 days.

(21) Appl. No.: 12/744,537

(22) PCT Filed: Dec. 4, 2008

(86) PCT No.: PCT/JP2008/072581

§ 371 (c)(1),
(2), (4) Date: May 25, 2010

(87) PCT Pub. No.: WO2009/075339

PCT Pub. Date: Jun. 18, 2009

(65) Prior Publication Data

US 2010/0245460 A1 Sep. 30, 2010

(30) Foreign Application Priority Data

Dec. 12, 2007 (JP) ..... 2007-320952
Sep. 8, 2008 (JP) ..... 2008-229693

(51) Int. Cl.
*B41J 2/15* (2006.01)
*B05C 11/00* (2006.01)

(52) U.S. Cl.
USPC ..... 347/20; 118/600

(58) Field of Classification Search
USPC ..... 347/20; 118/600; 427/294; 210/705; 202/197; 101/170; 239/398
See application file for complete search history.

(56) References Cited

U.S. PATENT DOCUMENTS 4,158,076 A * 6/1979 Wallsten ..... 427/294
4,203,837 A * 5/1980 Hoge et al. ..... 210/705
4,308,105 A * 12/1981 Schiffers et al. ..... 202/197

(Continued)

FOREIGN PATENT DOCUMENTS

EP 0089616 A2 9/1983
JP 59-69179 4/1984

(Continued)

OTHER PUBLICATIONS

Jan. 21, 2011 European search report in connection with counterpart European patent application No. 08 86 0317.

*Primary Examiner* — Stephen Meier
*Assistant Examiner* — Carlos A Martinez
(74) *Attorney, Agent, or Firm* — Cooper & Dunham LLP

(57) ABSTRACT

A disclosed image forming apparatus is capable of solving the problems of deterioration of a foam application function and driving systems caused by the dried and fixed foam remaining without being applied. The image forming apparatus includes a foam forming section forming foam, a reservoir section supplying foam formed by the foam forming section to an application roller, a discharge channel through which extra foam is collected from the reservoir section, and a heating unit for heating the extra foam to return the extra foam to a liquid form. The discharged liquid prepared by defoaming the foam discharged through the discharge channel is returned to a container containing the defoamed liquid.

12 Claims, 22 Drawing Sheets

(56) References Cited

U.S. PATENT DOCUMENTS

| | | | | |
|---|---|---|---|---|
| 4,474,110 | A * | 10/1984 | Rosner | 101/170 |
| 4,620,983 | A | 11/1986 | Zimmer | |
| 6,000,784 | A | 12/1999 | Takemoto et al. | |
| 6,183,079 | B1 | 2/2001 | Meade et al. | |
| 6,257,716 | B1 | 7/2001 | Yanagawa et al. | |
| 6,402,317 | B2 | 6/2002 | Yanagawa et al. | |
| 6,439,713 | B1 | 8/2002 | Noguchi et al. | |
| 6,623,816 | B1 | 9/2003 | Tanikawa et al. | |
| 6,627,015 | B1 | 9/2003 | Takemoto et al. | |
| 6,837,578 | B2 | 1/2005 | Tanikawa et al. | |
| 7,070,269 | B2 | 7/2006 | Tanikawa et al. | |
| 7,334,858 | B2 | 2/2008 | Kogure et al. | |
| 7,434,927 | B2 | 10/2008 | Sakuma et al. | |
| 7,621,632 | B2 | 11/2009 | Imoto et al. | |
| 7,682,016 | B2 | 3/2010 | Sakuma et al. | |
| 2007/0051832 | A1 * | 3/2007 | Jones et al. | 239/398 |
| 2008/0106566 | A1 | 5/2008 | Kogure et al. | |
| 2009/0052917 | A1 | 2/2009 | Kogure et al. | |
| 2010/0165016 | A1 | 7/2010 | Ichimura et al. | |

FOREIGN PATENT DOCUMENTS

| | | | |
|---|---|---|---|
| JP | 62-241572 | | 10/1987 |
| JP | 03162894 | A * | 7/1991 |
| JP | 7-100415 | | 4/1995 |
| JP | 8-323977 | | 12/1996 |
| JP | 8-327788 | | 12/1996 |
| JP | 2002-137378 | | 5/2002 |
| JP | 2003-205673 | | 7/2003 |
| JP | 2004-330569 | | 11/2004 |
| JP | 2005-138502 | | 6/2005 |
| WO | WO2007094245 | * | 8/2007 |
| WO | WO2009/008490 | A1 | 1/2009 |

* cited by examiner

IMAGE FORMING APPARATUS AND FOAM APPLICATION DEVICE

TECHNICAL FIELD

The present invention relates to an image forming apparatus and a foam application device.

BACKGROUND ART

Conventionally, an inkjet recording device has been known as an image forming apparatus such as a printer, a facsimile machine, a copier, and a multifunctional peripheral having those functions, the image forming apparatus employing the liquid-ejection recording method in which, for example, a recording head ejecting ink droplets is used. The image forming apparatus employing the liquid-ejection recording method is capable of ejecting droplets from its recording head onto a fed sheet (or an OHP sheet or any medium on which ink droplets or other liquid can be applied, and may be referred to as a recording medium, a recording paper, a recording sheet, or the like) to form (the terms "form", "record", "type", "image", and "print" may be regarded as synonymous with each other) an image on the fed sheet. The image forming apparatuses employing the liquid-ejection recording method include a serial-type image forming apparatus in which its recording head moves in the main scanning direction and ejects droplets to form an image, and a line-type image forming apparatus in which its recording head ejects droplets to form an image without moving.

In this description, the term "image forming apparatus" employing the liquid ejection recording method refers to an apparatus capable of forming an image by ejecting a fluid onto a medium such as a piece of paper, strings, fibers, silk fabric, metal, plastics, glass, wood, and ceramics. Further, the term "image forming" refers not only to forming an image having significant information such as letters or figures onto a medium but also to forming an image having no significant meaning such as patterns onto a medium (including a case where ink droplets are just discharged onto a medium). Further, the term "ink" is not limited to a material generally called ink but refers to any material which becomes a fluid upon being ejected such as DNA samples, resists, and pattern materials.

In such an image forming apparatus employing the liquid ejection recording method, ink droplets are formed out of ink including coloring material. Because of this feature, such image forming apparatus may have a drawback causing problems such as the feathering in which dots formed by droplets have an irregular (beard) shape, and color bleeding in which when ink droplets having different colors are applied adjacent to each other on a sheet, the ink droplets having different colors are mixed on the boundary between the droplets, thereby blurring the color on the boundary. In addition, there is another problem that it takes time to dry the droplets after being applied to the sheet.

To overcome the problems, according to, for example, Patent Document 1, a heating unit is provided for heating before or after the printing to control ink bleeding and dry the ink droplets quickly after being applied to the sheet. According to Patent Document 2, a pretreatment fluid is applied to the sheet by using an application roller so that the pretreatment fluid reacts with the ink droplets to control ink bleeding. According to Patent Document 3, a pretreatment fluid is ejected in a mist form from a fluid ejection head, and according to Patent Document 4, a treatment fluid is applied before or after printing to improve ink fixing performance.

[Patent Document 1] Japanese Laid-Open Patent Application No. H8-323977

[Patent Document 2] Japanese Laid-Open Patent Application No. 2002-137378

[Patent Document 3] Japanese Laid-Open Patent Application No. 2005-138502

[Patent Document 4] Japanese Laid-Open Patent Application No. 2003-205673

DISCLOSURE OF THE INVENTION

Problems to be Solved by the Invention

However, when a heating unit is added as described in Patent Document 1, energy consumption may be increased. Further, when the pretreatment fluid is applied by using the application roller or the fluid ejection head, the fluid may not be uniformly applied. In addition, since the fluid is additionally applied, it may become more difficult to quickly dry the sheet after the fluid reacts with the ink droplets on the sheet, and the sheet may be more likely to be curled or bent, which may cause problems such as jamming.

The present invention is made in light of the above circumstances and may provide an image forming apparatus in which a foam-like fluid, gel, or fluid and gel may be uniformly applied and the supply amount of the foam may be easily adjusted to maintain the quality of the foam to be applied. In addition, the inventors of the present invention have found a new problem that when a treatment fluid is foamed to prepare the treatment fluid in foam form and then the treatment fluid in foam form is applied, not all the treatment fluid in foam form may be applied. Namely, there is generated a residual treatment fluid in foam form (extra foam). In this case, when the extra foam is not applied to a process, the extra foam may be dried, and the dried component of the treatment fluid may be adhered. As a result, there may be some problems which may deteriorate the performance of applying the foam-like fluid (gel) (the fluid (gel) may not be uniformly applied) and the performance of a driving system.

The present invention is made in light of the above problems as well and may provide an image forming apparatus capable of solving the problems and maintaining the quality of the foam to be applied.

Means for Solving the Problems

According to an aspect of the present invention, an image forming apparatus includes an image forming unit forming an image on a recording medium; and a foam application unit applying foam to the recording medium or an intermediate member for applying the foam to the recording medium, the foam being prepared by forming at least one of a liquid and a gel. The foam application unit includes a foam forming unit forming the foam; an application unit applying the foam to the recording medium or the intermediate member; and a supplying unit introducing the foam from the foam forming unit and supplying the foam to the application unit through a supply opening. In this configuration, the supplying unit includes a discharge opening through which the foam that has not been supplied to the application unit is discharged, and the amount of foam introduced into the supplying unit is greater than that of foam supplied to the application unit.

Further, the fluid resistance of the foam at the discharge opening on the supplying unit when the foam is being discharged may be greater than the fluid resistance of the foam at the supply opening on the supplying unit when the foam is being supplied.

Further, the image forming apparatus may further includes a unit for varying a fluid resistance of the foam at the discharge opening on the supplying unit when the foam is being discharged.

Further, the image forming apparatus may further include a unit for varying the fluid resistance of the foam at the supply opening on the supplying unit when the foam is being supplied.

Further, the discharge opening may be positioned lower than the supply opening.

Further, the discharge opening may be disposed outside the application unit with respect to the width direction of the recording medium or the intermediate member.

According to another aspect of the present invention, an image forming apparatus includes an image forming unit forming an image on a recording medium; and a foam application unit applying foam to the recording medium or an intermediate member for applying the foam to the recording medium, the foam being prepared by forming a treatment liquid which is in at least one of a liquid form and a gel form. The foam application unit includes an application unit applying the foam; a channel collecting extra foam remaining without having been applied; and a heat unit heating the extra foam on the channel to return the extra foam to a liquid form.

Further, the heat unit may be in first-mode or second-mode operations; the heat unit heats the extra foam in the first-mode and the heat unit does not heat the extra foam in the second-mode.

Further, the image forming apparatus may further include a foam forming unit forming the foam out of the treatment liquid; and a treatment liquid container containing the treatment liquid to be supplied to the foam forming unit, or a waste liquid container. In this configuration, the channel may be in communication with the foam forming unit and the treatment liquid container or the waste liquid container.

Further, the heating unit may include plural surfaces each in contact with the extra foam.

Further, the extra foam refers to the foam that has not been supplied to the application unit.

According to another aspect of the present invention, a foam application device applies foam to a target application member, the foam being prepared by foaming at least one of a fluid or a gel. The foam application device includes a foam forming unit forming the foam; an application unit applying the foam to the target application member; and a supplying unit introducing the foam from the foam forming unit and supplying the foam to the application unit through a supply opening. In this configuration, the supplying unit includes a discharge opening through which the foam that has not been supplied to the application unit is discharged, and the amount of foam introduced into the supplying unit is greater than that of foam supplied to the application unit.

According to another aspect of the present invention, a foam application device applies foam to a target application member, the foam being prepared by foaming at least one of a fluid or a gel. The foam application device includes an application unit applying the foam; a channel collecting extra foam remaining without the foam having been applied; and a heat unit heating the extra foam on the channel to return the extra foam to a liquid form.

It should be noted that in the description, the term "foam" (may be also referred to as "foam-like fluid", or "foam-like gel") may refer to a fluid or a gel in foam form in which a large number of air bubbles are dispersed in the fluid or the gel so as to form the fluid or the gel with compressibility (aggregation of micro-bubbles) when the foam is being applied. In other words, the term "foam" may refer to a fluid or a gel bubble having a round shape and containing gas such as air inside the round shape, and is formed due to the surface tension of the fluid or the gel containing the gas inside so that a cubic (three-dimensional) shape of the foam can be sustained for a certain period of time. It should be noted that to sustain the cubic shape for the certain period of time, preferably, the foam has a bulk density equal to or less than 0.05 $g/cm^3$, the distribution range of the foam bubble diameters is between 10 μm and 1 mm, and an average foam bubble diameters is equal to or less than 100 μm. Further, the shape of a foam bubble is spherical when the foam bubble independently exists. However, when plural foam bubbles are aggregated together, each shape of the foam bubbles may become polyhedral due to their surface tensions. Further, the term "gel" refers to a semi-consolidated material having a net or honeycomb shape in which colloidal solution and high-molecular components dispersed in a disperse medium lose their independent mobility due to their mutual interactions and the particles of the material are in contact with each other.

EFFECTS OF THE PRESENT INVENTION

In an image forming apparatus and a foam application device according to an embodiment of the present invention, a discharge opening is formed on the supplying unit supplying the foam through the supply opening to the application unit applying foam to the target application member; and the amount of foam introduced into the supplying unit is greater than the amount of foam supplied to the application unit. By having these features, it may become possible to uniformly apply a fluid, a gel, or a fluid and a gel so as to form a film having a substantially even thickness, control the supply amount easily, and maintain the quality of the foam to be applied at a certain level.

Further, an image forming apparatus and a foam application device according to an embodiment of the present invention include the application unit applying the foam; the channel collecting extra foam remaining without having been applied; and the heat unit heating the extra foam on the channel to return the extra foam to a liquid form. By having these features, it may become possible to uniformly apply a fluid, a gel, or a fluid and a gel so as to form a film having a substantially even thickness, collect the extra foam, and waste the collected extra foam when necessary to maintain the quality of the foam to be applied at a certain level.

DESCRIPTION OF THE REFERENCE NUMERALS

100: RECORDING TARGET MEDIUM (SHEET)
101: RECORDING HEAD UNIT
102: FEEDING BELT
103: SHEET FEED TRAY
200: FOAM APPLICATION DEVICE
201: TREATMENT FLUID (A FLUID, A GEL, OR A FLUID AND GEL TO BE FOAMED)
205: FOAM FORMING SECTION
210: FOAM BUBBLES
211: RESERVOIR SECTION
212: APPLICATION ROLLER
231: INTRODUCING OPENING
232: SUPPLY OPENING
233: APPLICATION AMOUNT/APPLICATION AREA ADJUSTING SECTION
234: DISCHARGE OPENING
401: DISCHARGE CHANNEL
402: DISCHARGING PUMP
501: HEATING DEVICE

BEST MODE FOR CARRYING OUT THE INVENTION

Figure 1:
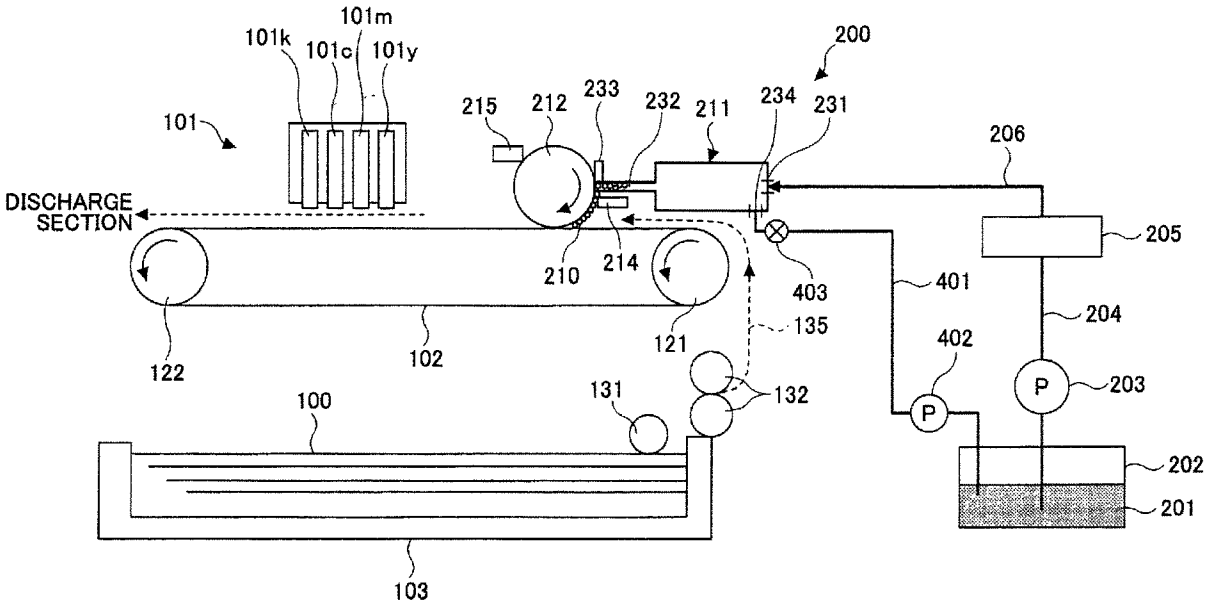
FIG. 1 is a view showing an exemplary configuration of an image forming apparatus including a foam application device according to an embodiment of the present invention.

In the following, embodiments of the present invention are described with reference to the accompanying drawings. First, an example of an image forming apparatus having a foam application device according to a first embodiment of the present invention is described with reference to FIG. 1. FIG. 1 is a schematic diagram showing an exemplary configuration of the image forming apparatus. As shown in FIG. 1, the image forming apparatus includes a recording head unit 101, a feeding belt 102, a sheet feed tray 103, and a foam application device 200 (a device for applying foam bubbles to an application target member) according to an embodiment of the present invention. The recording head unit 101 serves as an image forming unit by ejecting droplets onto a sheet 100 as a recording medium to be recorded to form an image on the sheet 100. The sheets 100 are stacked in the sheet feed tray 103. The feeding belt 102 feeds the sheet 100. The foam application device 200 is provided on the upstream side of the recording head unit 101 and applies a foam-like liquid to the sheet 100 which is an application target member.

The recording head unit 101 has the line-type fluid ejection heads for ejecting droplets. Each of the line-type fluid ejection heads has plural nozzles arranged along the width direction of the sheet 100. Namely, the recording head unit 101 includes recording heads 101*y*, 101*m*, 101*c*, and 101*k* for ejecting yellow (Y), magenta (M), cyan (C), and black (K) ink-droplets, respectively. It should be noted that the recording heads may be mounted on a carriage as the serial-type image forming apparatus.

The feeding belt 102 is an endless belt extended between a feeding roller 121 and a tension roller 122 to rotate between the rollers. The sheet 100 may held to the feeding belt 102 by using electrostatic attraction, vacuum suction, or other known holding means.

The sheets 100 stacked in the sheet feed tray 103 are picked up one by one by a pickup roller 131, and fed through a feeding path 135 and held onto the feeding belt 102 by a feeding roller pair 132 and another feed roller pair not shown).

Next, in the foam application device 200, foam bubbles 210 are applied to the sheet (hereinafter may be also referred to as a "recording target medium") 100 as the application target member fed on the feeding belt 102. The foam bubbles 210 applied to the sheet 100 are rapidly dried, and the droplets of each color are ejected from the recording head unit 101 to form an image on the sheet 100. Then, the sheet 100 is discharged to a discharge tray (not shown).

On the other hand, as shown in FIG. 1, the foam application device 200 includes a container 202, a pump 203, a foam forming section 205, a reservoir section (or a "foam supplying section") 211 and an application roller (or an "application member") 212. The container 202 contains a fluid, a gel, or a fluid and gel (hereinafter collectively referred to as a "treatment fluid" or a "set agent") 201 that can be changed to a foam form. The pump 203 pumps the treatment fluid 201 from the container 202. The foam forming section 205 forms the foam bubbles 210 from the treatment fluid 201 supplied from the pump 203 through a supply channel 204, each foam bubbles 210 having a short diameter so as to be adapted to the application of the foam bubbles 210. The foam bubbles 210 formed in the foam forming section 205 are introduced into the reservoir section 211 through a supply channel 206 and an introducing opening 231. In the reservoir section 211, the foam bubbles 210 are elongated and developed in the width direction of the recording target medium 100 (or may be an intermediate medium). The elongated and developed foam bubbles 210 are applied to the outer surface of the application roller 212 so that the application roller 212 serves as an applying unit applying the foam bubbles 210 to the recording target medium 100.

Further, the reservoir section 211 may adjust the amount of the foam bubbles 210 to be supplied to the application roller 212 (accordingly, an amount of the foam bubbles 210 applied from the application roller 212 to the recording target medium 100) by varying the fluid resistance of the foam bubbles 210 at a supply opening 232 (shown in FIG. 1). The reservoir section 211 further includes an application amount/application area adjusting section 233 and a discharge opening 234. The application amount/application area adjusting section 233 determines a supply area on the application roller 212 to which the foam bubbles 210 are supplied (namely, an application area defined by the application roller 212) by varying the size and the area of the supply opening 232 determined by the degree of opening/closing of the application amount/application area adjusting section 233. The foam bubbles 210 that have not been supplied to the application roller 212 (extra foam bubbles 210) are discharged through the discharge opening 234.

Further, in the foam application device 200, there is provided a discharge channel 401 by which there is communication between the discharge opening 234 and the container 202. An adjusting valve 403 and a discharging pump 402 are provided on the discharge channel 401. The adjusting valve 403 controls the amount of foam bubbles 210 to be discharged through the discharge opening 234 by varying the fluid resistance of the foam bubbles 210 at the discharge opening 234. The discharging pump 402 not only assists the discharge of the foam bubbles 210 from the discharge opening 234 to the container 202 but also defoams the foam bubbles 210 by compressing the foam bubbles 210. It should be noted that the foam bubbles 210 may be discharged to another tank such as a waste tank.

The foam application device 200 further includes a thickness control section 214 and a cleaning member 215. The thickness control section 214 controls the film thickness (application film thickness) of the foam bubbles 210 applied to the outer surface of the application roller 212. The cleaning member 215 removes the applied foam bubbles 210 remaining on the outer surface of the application roller 212.

Herein, the treatment fluid 201 that is formable may be a reforming agent reforming the surface of the sheet 100 upon being applied to the surface. For example, by uniformly applying the foam (fluid) 210 to the sheet 100 (not limited to paper as a material, as described), it becomes possible to promote the penetration of the water component of the ink, thicken the ink color components, and accelerate the drying of the ink, thereby serving as a fixing agent (a setting agent) capable of avoiding blurs (such as feathering and bleeding) and strike-through and improving the productivity (increasing the number of output sheets per unit time).

The treatment fluid 201 may be a solution including as components a surface active agent (one of anionic, cationic, and nonionic agents, or any combination thereof), a cellulose derivative (such as hydroxypropylcellulose) promoting the penetration of water, and a base such as talc particles. Fine particles may be added to the treatment fluid 201.

Preferably, as the foam content, the foam bubbles 210 have a bulk density of from about 0.01 g/cm$^3$ to about 0.1 g/cm$^3$.

By applying the foam bubbles 210 including a large amount of air to the sheet 100 as described above, it becomes possible to uniformly apply a small amount of fluid, that dries quickly, and obtain a high-quality image without causing blur, strike-through, uneven density, and the like.

Namely, when compared with a case where a treatment fluid in a fluid or mist form is applied, the application of the foamed treatment fluid may have the following advantages (effects):

(1): Foam includes a large amount of air. Therefore, applying only a small amount of fluid may be enough.

(2): Characteristics of foam are similar to those of solid materials. Therefore, the film thickness of applied foam may be easily controlled by, for example, cutting off the foam bubbles that have been applied. Further, when the foam bubbles are applied from an applying section to a sheet, the foam bubbles exhibit an excellent detachability from the applying section. Therefore, the foam can be uniformly applied.

(3) The water component of the applied foam hardly penetrates into the fibers of the sheet. Therefore, a wrinkle or a curl of the sheet may hardly occur.

Such advantages of applying foam may be commonly observed when any type of treatment fluid is used. Preferably, the treatment fluid 201 may further have the effects of controlling the generation of paper powder from the sheet 100 and changing the background color of the sheet 100.

On the other hand, in order to uniformly apply foam along the width direction with respect to the recording target medium (or may be an intermediate medium for further applying the applied foam to its recording target medium), it is necessary to sufficiently elongate and develop the foam bubbles in the above direction before the foam bubbles are applied. However, as described above, the characteristics of the foam bubbles are similar to those of solid materials. Therefore, it may not be easy to elongate and develop the foam bubbles along the width direction of the recording target medium or the intermediate medium. In addition, it may be difficult to control the amount of foam bubbles to be supplied to the applying section and to substantially maintain the bulk density, the foam density, and the diameters of the foam bubbles at certain target levels.

To overcome the difficulties, according to an embodiment of the present invention, in the foam supplying section supplying foam bubbles to the applying section through the supply opening so that the foam bubbles can be supplied from the applying section to the target application member, the discharge opening is formed to discharge the foam bubbles that have not been applied to the applying section, so that a larger number of foam bubbles than is necessary to be supplied to the applying section are introduced into the foam supplying section. By having this configuration, it becomes possible to allow the treatment fluid to be uniformly applied to form a film of the applied foam bubbles having a substantially even thickness, easily control the amount of foam bubbles to be applied, and maintain the quality of the foam bubbles to be applied at a certain level, thereby enabling improving the quality of the images formed on the sheet.

Figure 5:
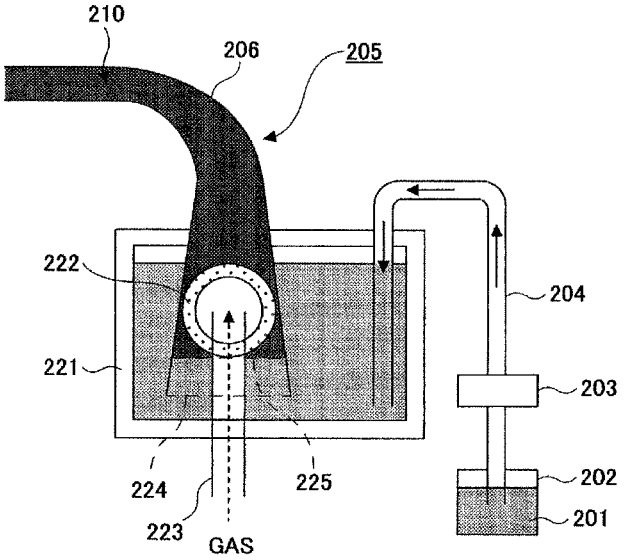
FIG. 5 is a schematic view showing an example of a foam forming section of the foam application device.

First, an exemplary configuration of the foam forming section 205 in the foam application device 200 is described with reference to FIG. 5. As shown in FIG. 5, the foam forming section 205 includes a container 221 containing the treatment fluid 201 pumped from container 202 by the pump 203, a porous member 222 having a cylindrical shape disposed in the container 221, and a gas supplying section 223 supplying gas inside the porous member 222. The gas supplying section 223 may have a fan and a duct to blow air inside the porous member 222. Further, one end of the supply channel 206 surrounds the porous member 222 so that the treatment fluid 201 to be foamed is sufficiently supplied to the porous member 222, and first slits 224 and second slits 225 are provided at the inlet section of the supply channel 206 (in the vicinity of the porous member 222) so that the formed foam bubbles 210 do not randomly spread around inside the container 221.

In this foam forming section 205, the foam bubbles 210 are formed out of the treatment fluid 201 by supplying air inside the porous member 222. While gas is being supplied, the formed foam bubbles 210 move (are fed) inside the supply channel 206 due to their own driving power (kinetic energy) to the reservoir section 211. When the air supply is stopped, the formation of the foam bubbles 210 is stopped, and accordingly, the movement of the foam bubbles 210 is stopped. As is described above, foam bubbles 210 move due to their own driving power. Therefore, the foam bubbles 210 can be moved and stopped without any additional moving means for moving foam bubbles.

Figure 6:
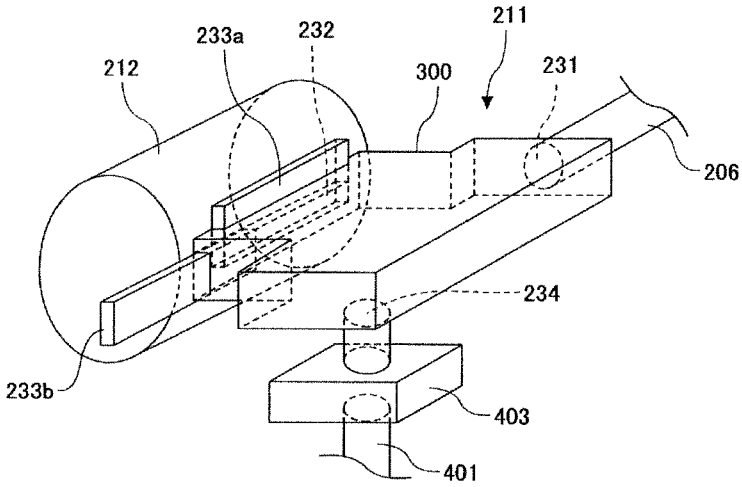
FIG. 6 is a schematic perspective view showing a first example of a reservoir section of the foam application device.

Next, an exemplary configuration of the reservoir section 211 in the foam application device 200 is described with reference to FIG. 6. FIG. 6 is a schematic perspective view of the reservoir section 211.

As shown in FIG. 6, the reservoir section 211 includes a foam reservoir container 300 and the application amount/application area adjusting section 233. In the foam reservoir container 300, there are provided an introduction opening 231 through which the foam bubbles 210 are supplied from the foam forming section 205 through the supply channel 206, the supply opening 232 through which the foam bubbles 210 are supplied to the application roller 212, and the discharge opening 234 through which the extra foam bubbles 210 are discharged. The application amount/application area adjusting section 233 is for varying the area of the supply opening 232.

In the reservoir section 211, the foam bubbles 210 supplied from the foam forming section 205 through the introduction opening 231 into the foam reservoir container 300 are pushed toward the side of the application roller 212 through the supply opening 232. When the adjusting valve 403 is closed and the foam bubbles 210 are supplied to the reservoir section 211, pressure is generated by the supply of the foam bubbles 210. Due to the pressure, the foam bubbles 210 in the reservoir section 211 are elongated and developed along the width direction of the sheet 100. In this case, the adjusting valve 403 is controlled to adjust the pressure so that the foam bubbles 210 be distributed throughout the reservoir section 211.

Then, at a prescribed timing, the adjusting valve 403 is open, so that while more foam bubbles 210 than is necessary to be supplied to the application roller 212 are being introduced (supplied) into the inside of the foam reservoir container 300, the extra foam bubbles 210 are discharged to the discharge channel 401 through the discharge opening 234. By doing this, it becomes possible to sufficiently apply the foam bubbles 210 along the prescribed width direction of the sheet 100. It should be noted that by controlling the adjusting valve 403, it becomes possible to vary the fluid resistance of the foam bubbles 210 at the discharge opening 234 so that the foam bubbles 210 in the reservoir section 211 be preferentially supplied to the application roller 212.

Figure 7:
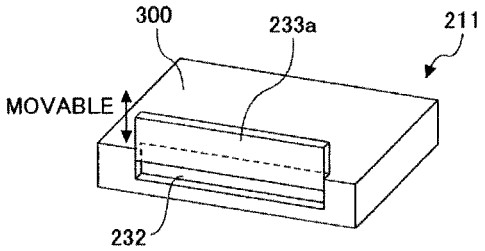
FIG. 7 is a schematic perspective view showing an example of an application amount/application area adjusting section of the foam application device.
Figure 8:
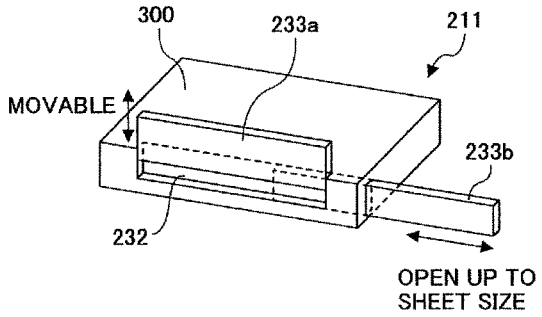
FIG. 8 is a schematic perspective view showing another example of the application amount/application area adjusting section of the foam application device.

The application amount/application area adjusting section 233 may include an adjustment plate 233*a* moving in the vertical direction to open/close the supply opening 232 as shown in FIG. 7. Otherwise, the application amount/application area adjusting section 233 may include not only the adjustment plate 233*a* moving in the vertical direction but also another adjustment plate 233*b* moving in the lateral direction (corresponding to the width direction of the sheet 100) to open/close the supply opening 232 as shown in FIGS. 6 and 8.

In the case of FIG. 7 where the application amount/application area adjusting section 233 includes only the adjustment plate 233*a*, the fluid resistance of the foam bubbles 210 at the supply opening 232 may be adjusted by varying the size of the supply opening 232 defined by moving the adjustment plate 233*a* in the vertical direction. By doing this, it becomes possible to adjust the application area on the application roller 212 with respect to the rotational direction of the application roller 212, thereby enabling controlling the application area on the sheet 100 with respect to the feeding direction of the sheet 100. On the other hand, in the case of FIG. 8 where the application amount/application area adjusting section 233 includes not only the adjustment plate 233*a* but also the adjustment plate 233*b*, the fluid resistance of the foam bubbles 210 at the supply opening 232 may be adjusted by varying the size of the supply opening 232 defined by moving the adjustment plate 233*a* in the vertical direction and moving the adjustment plate 233*b* in the lateral direction. By doing these things, it becomes possible to adjust the application area on the application roller 212 with respect to the rotational and the lateral directions of the application roller 212, thereby enabling controlling the application area on the sheet 100 with respect to the feeding and the width (orthogonal to feeding) directions of the sheet 100. In FIG. 8, the adjustment plate 233*b* is provided on one side of the supply opening 232. However, two adjustment plates 233*b* may be provided one on each side of the supply opening 232 so that the center with respect to the width direction of the sheet 100 becomes the center reference point when the sheet 100 is fed the feeding direction.

Figure 9:
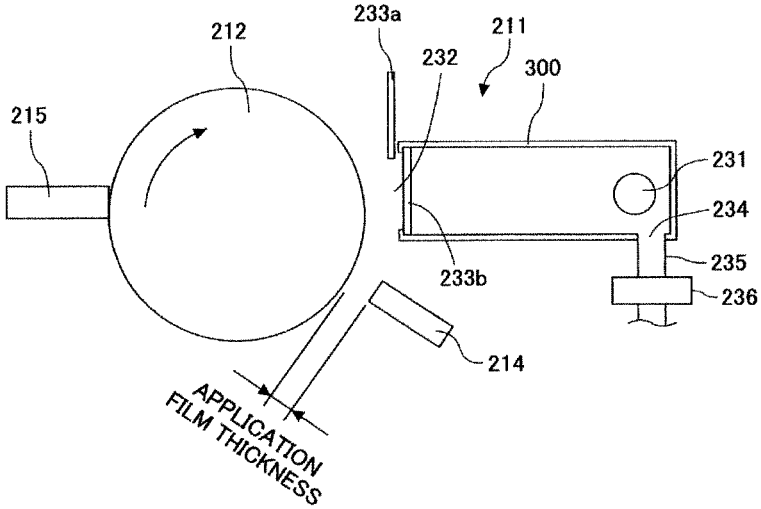
FIG. 9 is a view illustrating the adjustment of an application film thickness in the foam application device.

Further, the thickness control section 214 provided as shown in FIG. 9 optimally controls the film thickness of the foam bubbles 210 applied on the outer surface of the application roller 212 by adjusting the distance from the thickness control section 214 to the application roller 212. Further, for example, by performing a prescribed operation on a display operations section of an image forming apparatus, it becomes possible to move the thickness control section 214 by using driving means (not shown) in the tangential or normal direction with respect to the circumferential surface of the application roller 212. By doing this, it becomes possible to set an optimal application film thickness of the applied foam bubbles.

Figure 2:
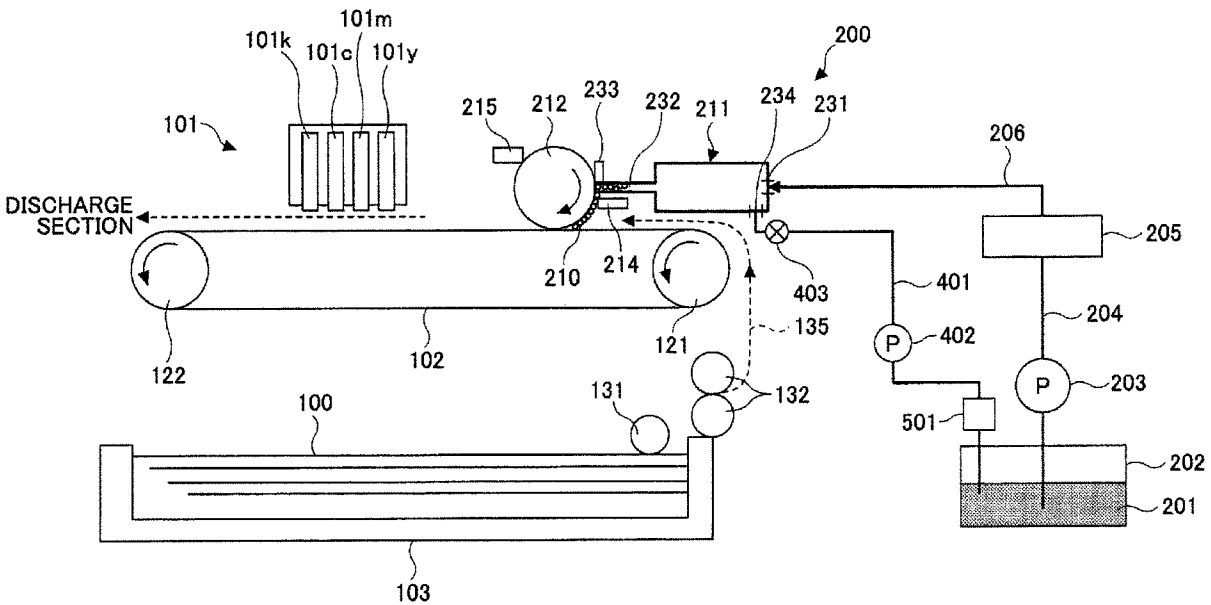
FIG. 2 is a view showing another exemplary configuration of an image forming apparatus including a foam application device according to an embodiment of the present invention.
Figure 3:
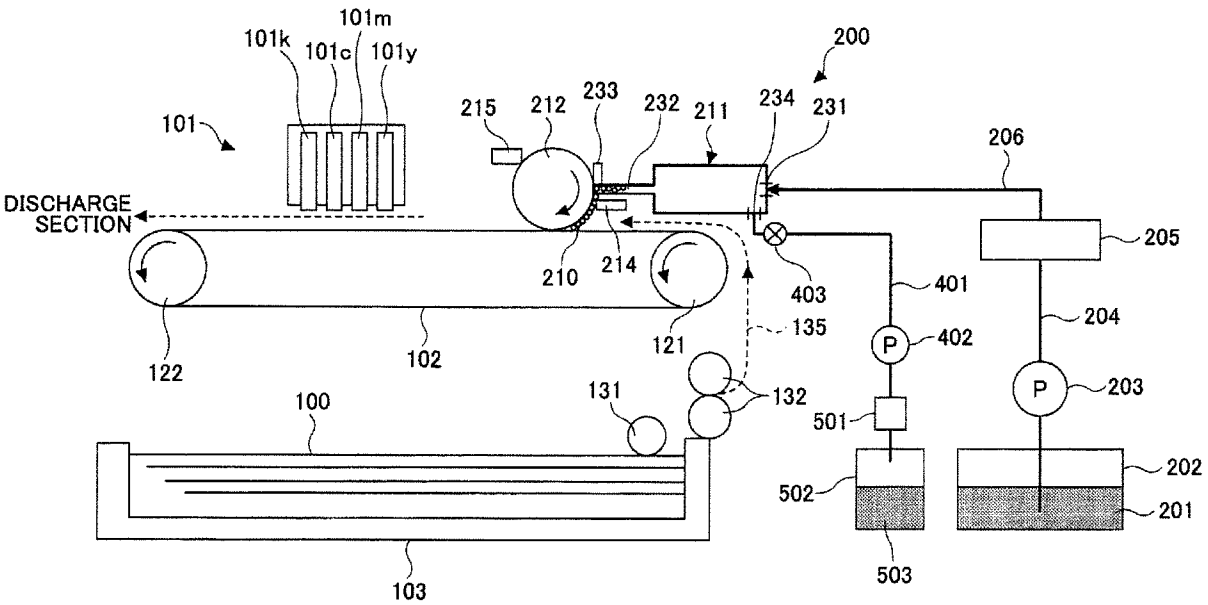
FIG. 3 is a view showing still another exemplary configuration of an image forming apparatus including a foam application device according to an embodiment of the present invention.
Figure 4:
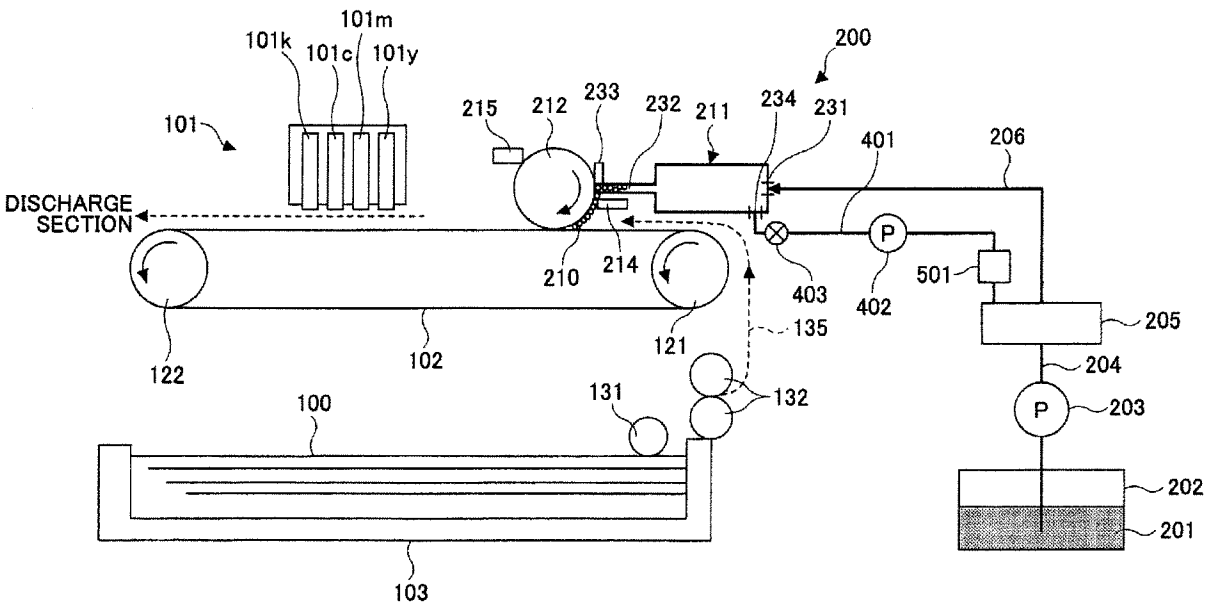
FIG. 4 is a view showing still another exemplary configuration of an image forming apparatus including a foam application device according to an embodiment of the present invention.

Next, other examples of an image forming apparatus having a foam application device according to other embodiments of the present invention are described with reference to FIGS. 2 through 4. In the figures, the same reference numerals are used for the same components in FIG. 1 and the descriptions thereof are herein omitted. As shown in FIG. 2, on the discharge channel 401 providing communication between the discharge opening 234 and the container 202, a heating device 501 is provided on the downstream side of the discharging pump 402. The heating device 501 heats the extra foam bubbles discharged through the discharge channel 401 and returns the discharged foam bubbles to a liquid form.

When the foam bubbles are heated by the heating device 501, the films of the foam bubbles are dried and the thickness of the films becomes thinner. In addition, the internal part of the foam bubbles is thermally expanded and accordingly the internal pressure of the foam bubbles is increased. As a result, the thickness of the films becomes further thinner, thereby sufficiently defoaming the foam. After being defoamed, the foam bubbles becomes a discharge liquid (herein referred to as a "reduction treatment liquid"). This reduction treatment liquid may be collected in the container 202 to be used as the foam again.

In this example, the discharge channel 401 is in communication with the container 202 which is a treatment liquid containing section for containing the treatment fluid 201. However, as shown in FIG. 3, the discharge channel 401 may be in communication with a waste tank 503 which is a waste liquid containing section. Otherwise, as shown in FIG. 4, the discharge channel 401 may be in communication with the foam forming section 205 so that the discharged foam can be foamed in the foam forming section 205 to be used again.

As described above, the foam bubbles 210 is a fluid or a gel having a round shape and containing gas such as air inside the round shape, and is formed due to the surface tension of the fluid or the gel containing the gas inside so that a cubic (three-dimensional) shape of the foam can be maintained for a certain period of time. Preferably, the foam has a bulk density equal to or less than 0.05 g/cm$^3$, the distribution range of the foam bubble diameter is between 10 μm and 1 mm, and an average foam bubble diameter is equal to or less than 100 μm. Further, the shape of a foam bubble is spherical when the foam bubble exists alone. However, when plural foam bubbles are aggregated together, each shape of the foam bubbles becomes polyhedral due to their surface tensions.

Figure 10:
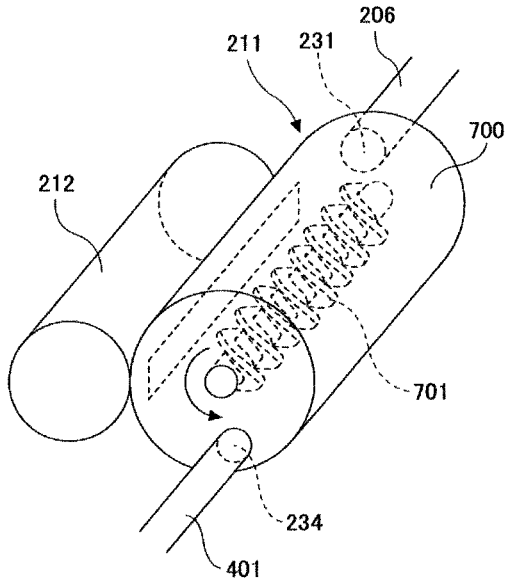
FIG. 10 is a schematic perspective view showing a second example of the reservoir section of the foam application device.

Next, another example of an image forming apparatus having a foam application device according to a second embodiment of the present invention is described with reference to FIG. 10. FIG. 10 is a schematic diagram showing an exemplary configuration of the reservoir section in the foam application device. As shown in FIG. 10, the reservoir section 211 includes a foam reservoir container 700 having a cylindrical shape. The introduction opening 231 is formed on one end side in the axis direction of the foam reservoir container 700. The discharge opening 234 is formed on the other end side in the axis direction of the foam reservoir container 700. Further, in the foam reservoir container 700, a feeding agitation member 701 having a screw shape is disposed along the axis direction of the foam reservoir container 700, so that the foam bubbles 210 can swiftly and uniformly spread around the supply opening 232 as the feeding agitation member 701 rotates. By having this structure, it becomes possible to feed the foam bubbles 210 from the introduction opening 231 to the discharge opening 234 in a short period.

Further, as shown in FIG. 10, the introduction opening 231 and the discharge opening 234 may be formed on the upper and lower sides of the reservoir container 700, respectively. By doing this, it may become possible to effectively collect the foam which is lacking uniformity due to defoaming of the foam bubbles 210. This is because defoamed foam bubbles are likely to be sunk due to their greater specific gravity. Therefore, preferably, the discharge opening 234 is formed lower than the introduction opening 231. More preferably, the discharge opening 234 is formed at the lowest part of reservoir container 700.

Figure 11:
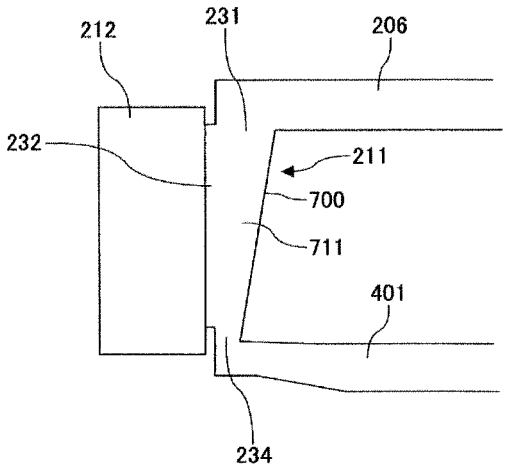
FIG. 11 is a schematic perspective view showing a third example of the reservoir section of the foam application device.

Next, still another example of an image forming apparatus having a foam application device according to a third embodiment of the present invention is described with reference to FIG. 11. FIG. 11 is a schematic plan view showing an exemplary configuration of the reservoir section in the foam application device. As shown in FIG. 11, a channel 711 provides communication between the introduction opening 231 and the discharge opening 234, and the width of the channel 711 becomes narrower as the foam approaches the discharge opening 234. The supply opening 232 is formed along the direction from the introduction opening 231 to the discharge opening 234 (parallel to the axis direction of the application roller 212). By having this structure, a supply pressure of the foam bubbles 210 becomes constant along the longitudinal direction of the supply opening 232 and a time period required to fill the entire reservoir section 211 with the foam bubbles 210 may be reduced because the width of the channel 711 is gradually reduced.

Figure 12:
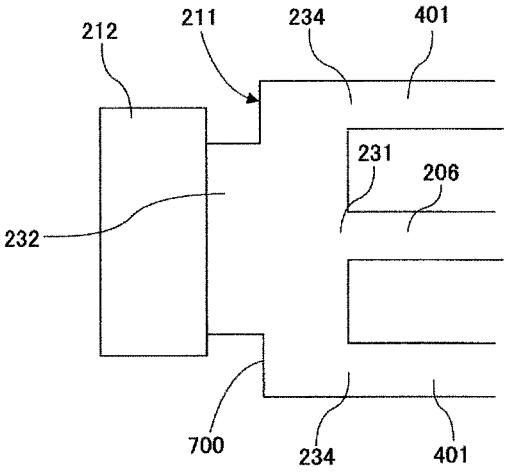
FIG. 12 is a schematic perspective view showing a fourth example of the reservoir section of the foam application device.

Next, still another example of an image forming apparatus having a foam application device according to a fourth embodiment of the present invention is described with reference to FIG. 12. FIG. 12 is a schematic plan view showing an exemplary configuration of the reservoir section in the foam application device. As shown in FIG. 12, the discharge openings 234 are formed one on each side of the reservoir container 700, and the introduction opening 231 is formed between the discharge openings 234. The supply opening 232 is formed along the arranging direction of the discharge opening 234, the supply opening 232, and the other discharge opening 234 (parallel to the axis direction of the application roller 212). By having this structure, the foam bubbles 210 introduced through the introduction opening 231 are spread toward both side ends simultaneously and the distance necessary for the foam bubbles 210 to be spread throughout the reservoir container 700 becomes shorter. Therefore, the foam bubbles 210 may fill the reservoir section 211 in a shorter time period. Further, the distance between the supply opening 232 and each of the discharge openings 234 becomes shorter. Therefore, the supply pressure of the foam bubbles 210 along the longitudinal direction of the supply opening 232 may become substantially constant more accurately.

Preferably, each of the discharge openings 234 is disposed outside the application roller 212 (outside of the supply opening 232) with respect to the width direction of the sheet 100. By having this structure, residual foam bubbles 210 may be avoided and the defoamed foam lacking uniformity may be discharged more easily.

Figure 14:
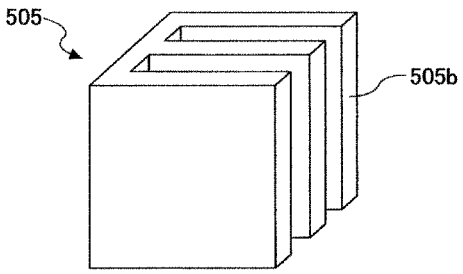
FIG. 14 is a perspective view showing another example of the heating device.
Figure 15:
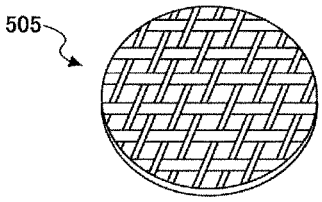
FIG. 15 is a perspective view showing still another example of the heating device.

Next, exemplary configurations of the heating device 501 are described with reference to FIGS. 13 through 15. Each of the heating devices 501 is provided on the discharge channel 401, and as is described above, defoams the extra foam bubbles discharged in the discharge channel 401 (returns the discharged foam bubbles to a liquid form) by heating the extra foam bubbles. The heating device 501 shown in FIG. 13 includes a heat transfer section 505 and a heating section 504 transferring heat to the heat transfer section 505.

Figure 13:
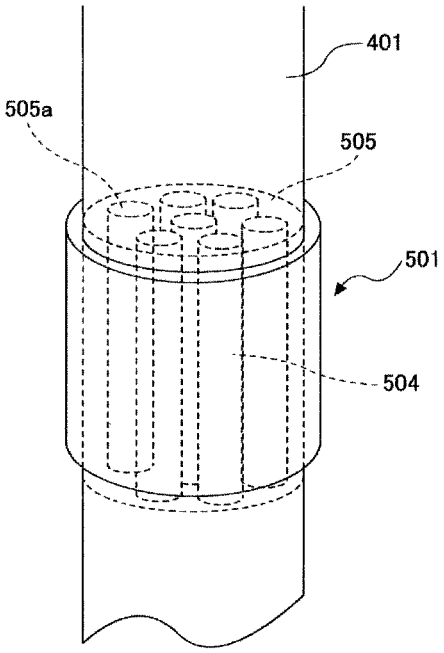
FIG. 13 is a perspective view showing an example of a heating device.

As shown in FIG. 13, the heat transfer section 505 may have plural holes (through holes) 505*a* formed along the direction parallel to the discharge direction of the foam bubbles to increase the area for contacting the foam bubbles. However, the shape or the configuration of the heat transfer section 505 is not limited to this. The similar effect to that in FIG. 13 may be obtained when the heat transfer section 505 has comb-shaped fins 505*b* like a heatsink as shown in FIG. 14 or has a net filter as shown in FIG. 15. Namely, preferably, the heat transfer section 505 has a structure having as many surface areas to contact the extra foam bubbles discharged through the discharge channel 401 as possible. Further, the heat transfer section 505 may be made of aluminum having excellent heat conductivity and corrosion resistance. However, the material of the heat transfer section 505 is not limited to aluminum. For example, the heat transfer section 505 may be formed of a copper alloy, a metal such as an SUS, or a plastic having excellent heat conductivity.

In the example of FIG. 13, the heating section 504 is formed so as to cover the circumference of the heat transfer section 505. However, the heating method or the heat transfer method are not limited to those described above. For example, the heat transfer method may be based on any of conduction, convention, and radiation, and the heating method may be microwave heating, electromagnetic induction heating, radiant heating, resistance heating, or the like.

Figure 16:
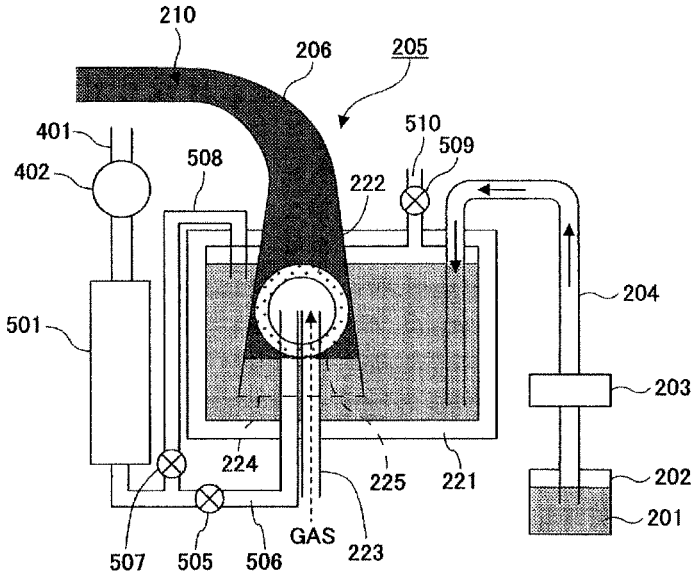
FIG. 16 is a schematic view showing where extra foam bubbles are collected in the foam forming section in an image forming apparatus in FIG. 4.
Figure 17:
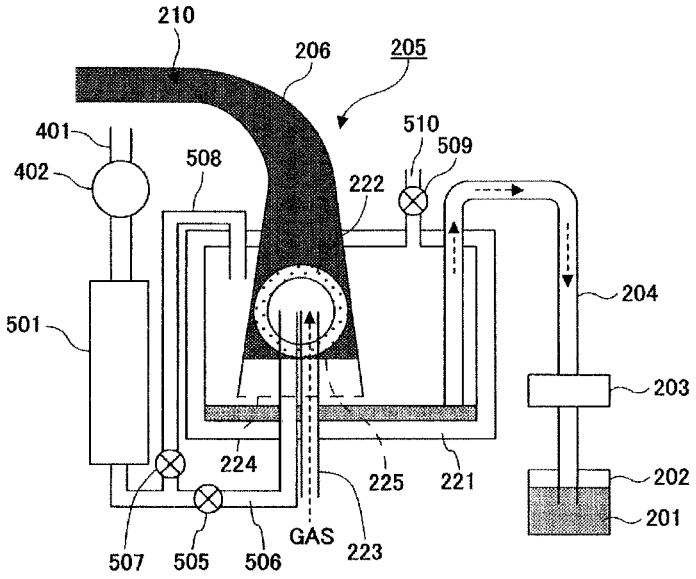
FIG. 17 is a schematic view showing a foam collection and cleaning operation in the foam forming section in an image forming apparatus in FIG. 4.

Next, an example (in FIG. 4) where the reduction treatment liquid is collected into the foam forming section 205 is described with reference to FIGS. 16 and 17.

The discharging pump 402 is provided on the upstream side of the heating device 501, so that the extra foam bubbles are discharged toward the downstream side. On the downstream side of the discharging pump 402, the extra foam bubbles are heated by the heating device 501 to be defoamed and returned to a liquid form.

Further, on the downstream side of the heating device 501, the discharge channel 401 is divided into two channels 506 and 508, and valves 505 and 507 are provided on the channels 506 and 508, respectively. On the downstream side of the valve 505, the channel 506 is in communication with the inside of the porous member 222 having a cylindrical shape. On the downstream sides of the valve 507, the channel 508 is provided to the inside of the container 221, so that the channel 508 is in communication with the atmosphere above the liquid surface or the inside of the treatment fluid 201 in the container (foam foaming container) 221. Further, an atmosphere communication channel 510 is provided to cause communication between the inside of the container 221 and the atmosphere outside the container 221. On the atmosphere communication channel 510, an atmosphere open valve 509 for opening/closing the atmosphere communication channel 510 is provided so that the air inside of the container 221 is released to outside the container 221.

Figure 18:
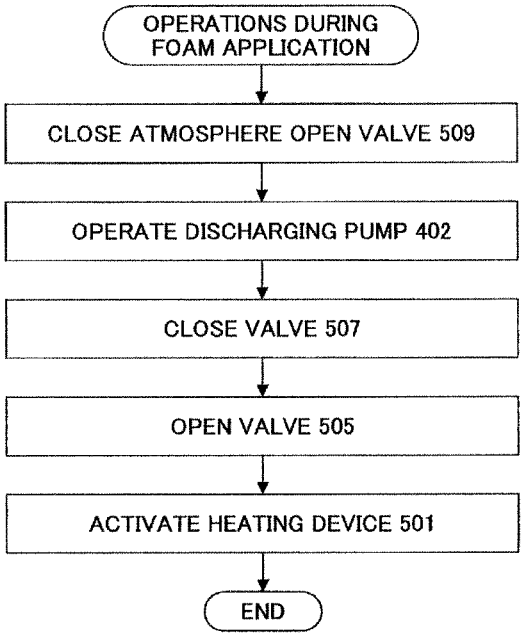
FIG. 18 is a flowchart showing a process of the operations (a first mode operation) during the foam application.

Next, in the example where the reduction treatment liquid is collected into the foam forming section 205, an operation controlled by a foam controlling section described below during the foam application is described with reference to a flowchart of FIG. 18.

In this operation during the foam application, the atmosphere open valve 509 for the foam foaming container 221 is closed; the discharging pump 402 is activated to operate; the valve 507 is closed, the valve 505 is open; and the heating device 501 is deactivated.

Namely, during the foam application, the foam bubbles 210 foamed in the foam forming section 205 are fed to the reservoir section 211 and applied to the application roller 212 for the foam application. Then, the extra foam bubbles remaining in the reservoir section 211 without being applied to the application roller 212 are fed toward the foam forming section 205 by the discharging pump 402 through the discharge channel 401. Then, since the valve 507 on the channel 508 is closed and the valve 505 on the channel 506 is open, the extra foam bubbles are fed to the inside of the porous member 222 having a cylindrical shape through the channels 506 so that the extra foam bubbles may be used for another foam forming.

Then, during the foam application, since the extra foam bubbles are used for another foam forming, it is not necessary to defoam the extra foam bubbles. Therefore, the heating device 501 is deactivated. Namely, the extra foam bubbles are fed and collected in the foam forming section 205 without being heated by the heating device 501 to be returned to a liquid form. Further, the atmosphere open valve 509 is closed to maintain the pressure in the container 221 substantially constant. In this description, the operation during the foam application is referred to as a first mode operation.

Figure 19:
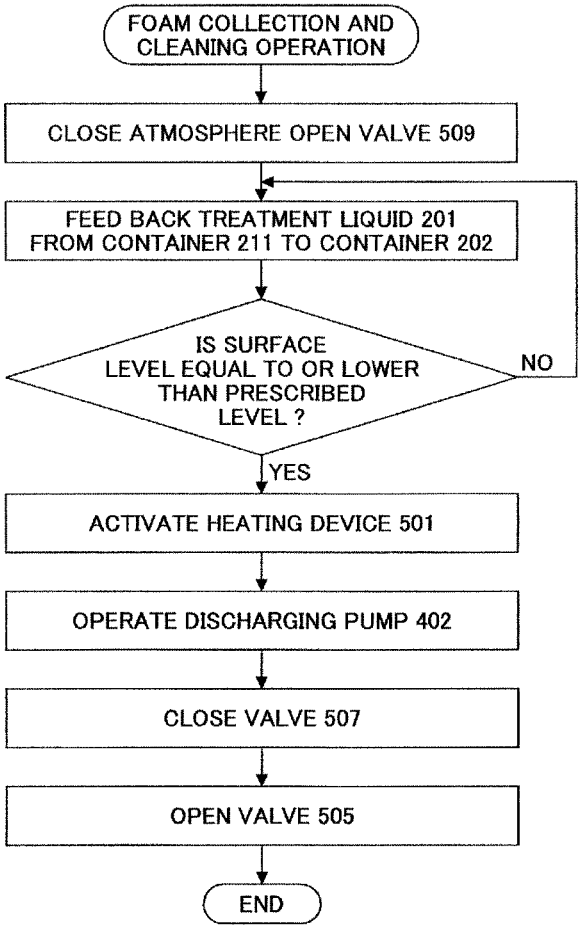
FIG. 19 is a flowchart showing a process of the operations (a second mode operation) during the foam collection and cleaning operation.

Next, a control in a case where the process of the foam application is finished and the extra foam bubbles are collected and cleaned is described with reference to a flowchart of FIG. 19.

In the foam collection and cleaning operation, the atmosphere open valve 509 for the foam foaming container 221 is open, the pump 203 is reversely rotated so that the treatment fluid 201 is fed toward the container 202 from the foam foaming container 221. After the surface height of the treatment fluid 201 in the foam foaming container 221 is lowered to a prescribed level, the heating device 501 is activated for heating; the discharging pump 402 is activated for pumping; the valve 505 is closed; and the valve 507 is open.

Namely, to collect the extra foam bubbles, the atmosphere open valve 509 is open to maintain the atmosphere pressure in the foam foaming container 221 substantially equal to the atmosphere outside the foam foaming container 221, the treatment fluid 201 in the foam foaming container 221 is fed into the container 202 to lower the surface height of the treatment fluid 201 in the foam foaming container 221 to the level where foam bubbles cannot be formed (lower than that of the first slits 224). In this state, by operating the discharging pump 402, a negative pressure is generated in the supply channel 206, and gas is introduced into the supply channel 206 through the first slits 224, so that the foam bubbles in the entire supply channel 206 may be substantially fully pushed out to the reservoir section 211.

Then, the heating device 501 is activated and the discharging pump 402 is operated. By doing this, the extra foam bubbles are discharged from the reservoir section 211 to the discharge channel 401. and the discharged extra foam bubbles are heated by the heating device 501, so that the extra foam bubbles are exploded and separated into fluid and gas. During this process, the valve 505 is closed and the valve 507 is open. Therefore, a liquid defoamed from the foam bubbles (reduction treatment liquid) is discharged to the fluid surface of the treatment fluid 201 in the foam foaming container 221 from the upper side of the foam foaming container 221 through the channel 508. In this description, this foam collection and cleaning operation is referred to as a second mode operation.

In this case, a mixture of gas and liquid is discharged from the outlet of the divided channel 508. If the mixture is discharged from the outlet of the divided channel 508 directly in the treatment fluid 201, the treatment fluid 201 may be foamed again when the gas rises in the treatment fluid 201 from the outlet of the divided channel 508. To avoid the foaming of the treatment fluid 201 again, as described above, the liquid surface of the treatment fluid 201 in the container 221 is lowered and the mixture is discharged above the liquid surface of the treatment fluid 201.

Next, the control section of the above image forming apparatus is briefly described with reference to the block diagram of FIG. 20

Figure 20:
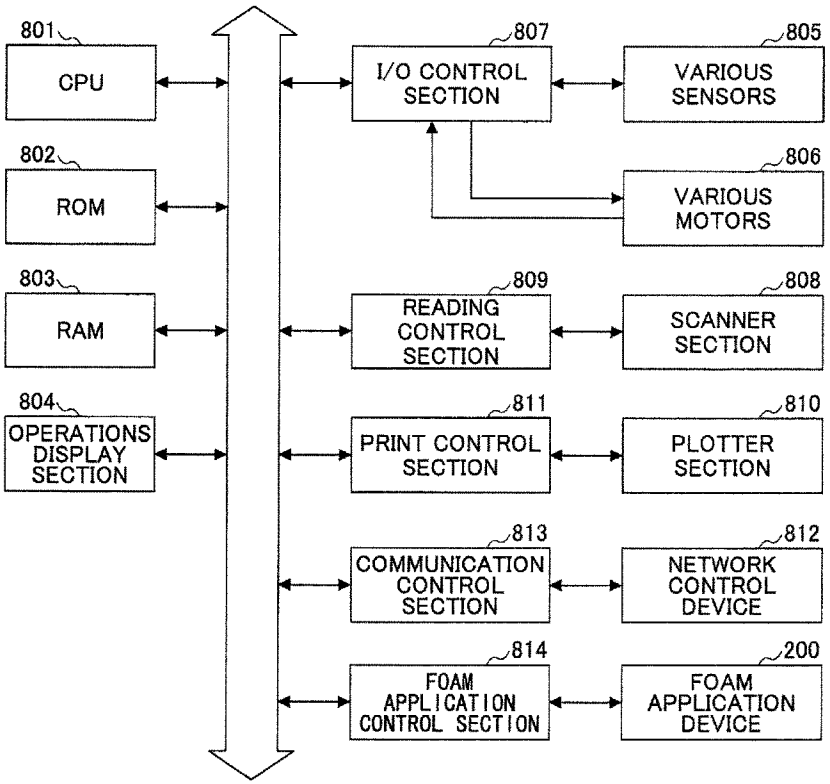
FIG. 20 is a schematic block diagram of a control section of the image forming apparatus.

As shown in FIG. 20, the control section may include a CPU 801, a ROM 802, a RAM 803, an operations display section 804, various sensors 805, various motors 806, an I/O control section 807, an image reading device (scanner) 808, a reading control section 809, a plotter section (print mechanism section) 810, a print control section 811, a network control device 812, a communication control section 813, and a foam application control section 814. The CPU 801 performs system control of the image forming apparatus. The ROM 802 stores, for example, programs to be executed by the CPU 801. The RAM 803 is used as a working area. An operator can perform various settings on the operations display section 804. The various sensors 805 detect size of the sheet, jams, and the like. The I/O control section 807 transmits and receives control signals to and from the various sensors 805 and the various motors 806. The reading control section 809 controls the image reading device (scanner) 808. The print control section 811 controls the plotter section (print mechanism section) 810. The communication control section 813 controls the network control device 812 performing I/F control for a telephone line and various facsimile communications, and the like. The foam application control section 814 controls the foam application device 200.

In this case, the various sensors 805 include a liquid end detector detecting whether the treatment fluid 201 is present in the container 202; the various motors 806 include motors for driving the pump 203, the application amount/application area adjusting section 233, and the thickness control section 214, and rotating the application roller 212, the feeding roller 121, the feeding roller pair 132, the pickup roller 131, and the like.

Further, in addition to the control of the foam application, the foam application control section 814 performs other controls during the foam application and the control of the foam collection and cleaning operation as described with reference to FIGS. 18 and 19.

An exemplary printing operation in the image forming apparatus is described with reference to the flowcharts in FIGS. 21 through 23.

Figure 21:
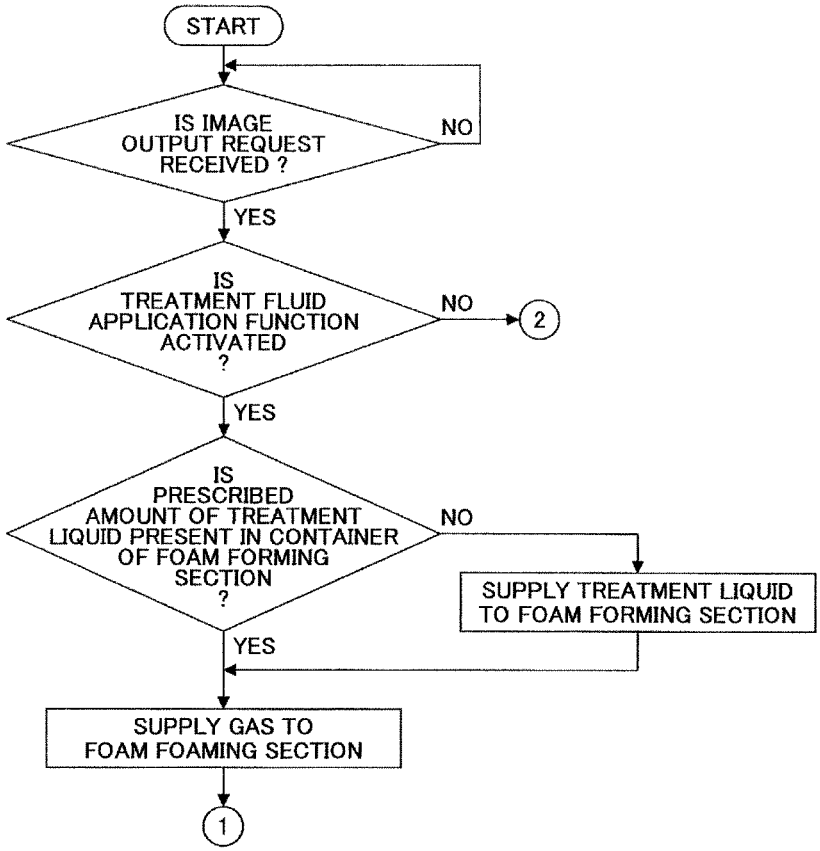
FIG. 21 is a flowchart showing an exemplary printing process by the control section.

Referring to FIG. 21, when an image output request is received, it is determined whether the treatment fluid (setting agent) application function is activated. Then, when it is determined that the treatment fluid application function is activated, it is further determined whether at least a prescribed amount of the treatment fluid 201 is present in the container 221 of the foam forming section 205. When it is determined that less than the prescribed amount of the treatment fluid 201 is present in the container 221, the pump 203 is operated to supply the treatment fluid 201 from the container 202 to the container 221 of the foam forming section 205. On the other hand, when it is determined that at least the prescribed amount of the treatment fluid 201 is present in the container 221, gas is supplied to the foam forming section 205 to form the foam bubbles 210 without supplying additional treatment fluid 201 to the container 221. By doing this, as described above, the foam bubbles 210 are supplied to the reservoir section 211 and elongated and developed in the reservoir section 211, and the extra foam bubbles 210 are discharged through the discharge opening 234 and the discharge channel 401.

Figure 22:
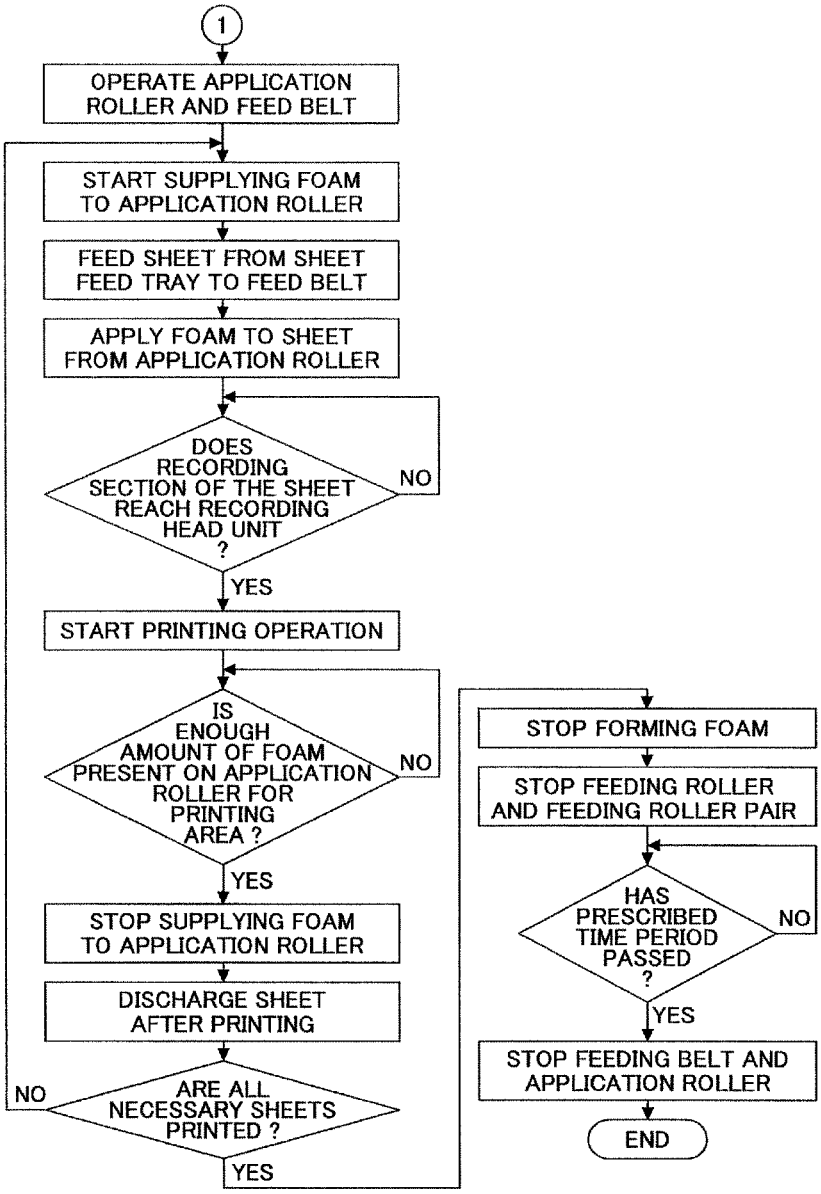
FIG. 22 is a flowchart showing a process following the process in FIG. 21.
Figure 23:
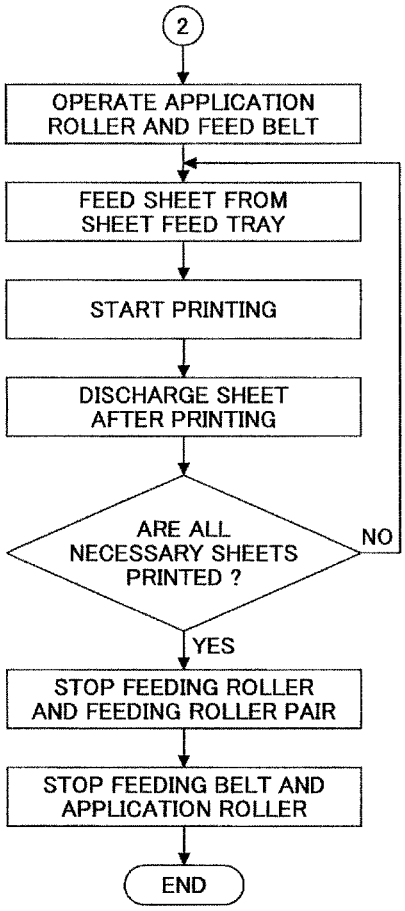
FIG. 23 is a flowchart showing a process following the process in FIG. 21.

Then, as shown in FIG. 22, the discharge channel 401 and the feeding belt 102 are driven to start the operations, and the application amount/application area adjusting section 233 moves to open the supply opening 232 at a prescribed timing to start applying the foam bubbles 210 to the surface of the application roller 212. By doing this, the foam bubbles 210 are applied to the surface of the application roller 212 and thickness control section 214 controls the thickness of the applied foam bubbles 210 so that the foam bubbles 210 have a prescribed thickness, and the applied foam bubbles 210 are transferred to the feeding belt 102.

Then, the recording target medium (sheet) 100 is fed from the sheet feed section (sheet feed tray 103) to the feeding belt 102. The foam bubbles 210 are applied to the fed recording target medium 100 by the application roller 212, and a printing operation starts when the recording section of the recording target medium 100 reaches the recording head unit 101. On the other hand, when the amount of the foam bubbles 210 applied to the application roller 212 reaches the necessary amount for the printing area of the sheet 100, the supply opening 232 is closed by the movement of the amount/application area adjusting section 233 of the reservoir section 211 to stop the supply of the foam bubbles 210 to the application roller 212.

After the printed recording target medium 100 is discharged, the same process from feeding the sheet is repeated until all necessary sheets are printed. When the all necessary sheets are printed, the supply of the gas to the foam forming section 205 is stopped to stop forming the foam bubbles. Then, the operations of the feeding roller 121 and the feeding roller pair 132 are stopped. Then, after a prescribed time period necessary for the successful completion of the cleaning operation, the feeding belt 102 and the application roller 212 are stopped.

On the other hand, in the process of FIG. 21, when it is not necessary to apply the foam bubbles 210 of the treatment fluid 201 because, for example, a special type of the recording target medium 100 is used, the treatment fluid application function should be deactivated. When the treatment fluid application function is not activated, the process goes to the process shown in FIG. 23. In the process, the feeding belt 102 and the application roller 212 are operated, and the recording target medium 100 is fed from the sheet feed section, printed by the recording head unit 101, and discharged. Then, when all the necessary media are printed, the operations of the feeding roller 121 and the feeding roller pair 132 are stopped. Then, after a prescribed time period, the feeding belt 102 and the application roller 212 are stopped.

In this process, the application roller 212 is being rotated. This is because the maximum gap between the application roller 212 and the feeding belt 102 is narrower than the of total thickness of the thickness of the sheet 100 and the thickness of the foamed setting agent (foam) 210. Therefore, application roller 212 is rotated so as not to obstruct the feeding of the recording target medium 100.

It should be noted that in the above embodiment, the foam application device 200 applies foam bubbles to the sheet on which an image is to be formed. However, for example, the foam application device 200 may be disposed on the downstream side of the recording head unit so that the foam bubbles are applied to the sheet on which an image has been formed already. Further, in the above embodiment, the foam bubbles are formed of a liquid that can be foamed. However, for example, the present invention may also be applied to a device capable of applying the foam bubbles to an application member, the foam bubbles being formed of a gel that can be foamed, and an image forming apparatus including the device.

Further, in the above embodiment, a case is described where the extra foam bubbles that have not been supplied to the application member (application means such as the application roller) are collected. However, the foam bubbles remaining on the application member may be scraped off and cleaned by a cleaning member, so that the foam bubbles scraped off by the cleaning member are collected through a channel, and a heating device may be provided on the channel.

Further, the foam application device according to an embodiment of the present invention may be applied to an electrophotographic-type image forming apparatus, and a fixing method, a fixing device, an image forming method, and an image forming apparatus using a foam-like fixing liquid for fixing resin fine particles to a medium by applying a small amount of the foam-like fixing liquid to the medium without leaving residual oil on the applied medium, the foam-like fixing liquid being capable of being rapidly fixed to the medium on which resin fine particles are adhered after being applied to the medium without disturbing the fine particles including resin such as toner on the medium such as a sheet.

Figure 24A:
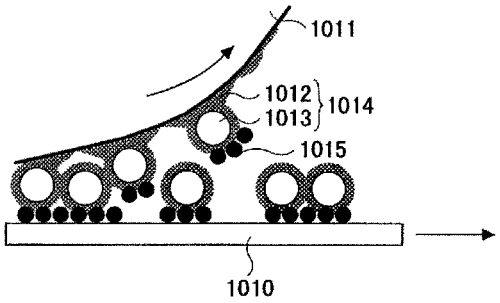
FIGS. 24A and 24B are partially enlarged views showing parts where the application surface of an application roller is in contact with unfixed resin fine particles when a relatively high pressure is applied on the contact surface between the application roller and a recording medium in a case where the foam application device is applied to an electrophotographic-type image forming apparatus.
Figure 24B:
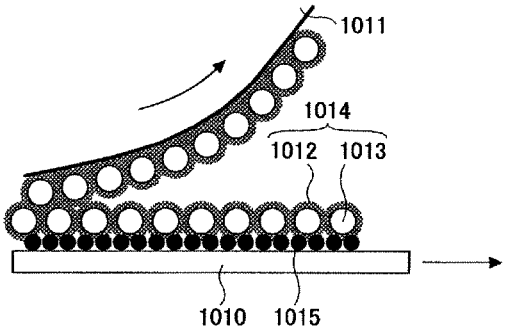
Figure 25A:
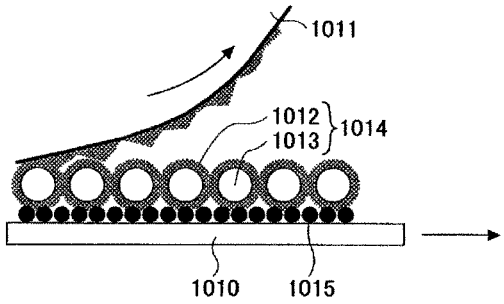
FIGS. 25A and 25B are partially enlarged views showing parts where the application surface of an application roller is in contact with unfixed resin fine particles when a relatively low pressure is applied on the contact surface between the application roller and a recording medium in a case where the foam application device is applied to an electrophotographic-type image forming apparatus.
Figure 25B:
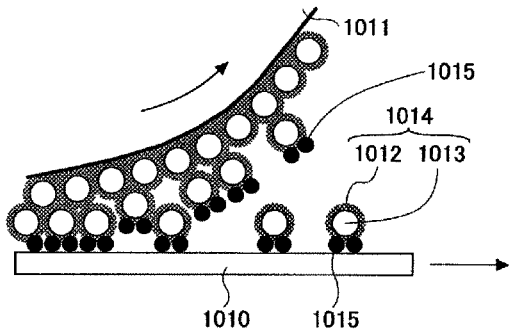

Therefore, as an example, a case is described where the present invention is applied to an electrophotographic-type image forming apparatus with reference to FIGS. 24A through 25B. FIGS. 24A through 25B are partially enlarged views showing a part where an application surface of a roller (roller application means) is in contact with unfixed resin fine particles. FIGS. 24A and 24B show cases where a relatively high pressure is applied on the contact surface between an application roller 1011 and a recording medium 1010. On the other hand, FIGS. 25A and 25B show cases where a relatively low pressure is applied on the contact surface between the application roller 1011 and the recording medium 1010. In the figures, it is assumed that the application roller 1011 rotates and the recording medium 1010 is fed in the corresponding directions designated by arrows in the figures.

First, the case is described where the relatively high pressure is applied on the contact surface between the application roller 1011 and the recording medium 1010. FIG. 24A shows a case where a foam-like fixing liquid 1012 forming a single layer of bubbles 1013 is applied to the application surface of the application roller 1011. It should be noted that the diameters of the bubbles shown in FIGS. 24A through 25B are substantially the same as each other. Therefore, a layer thickness of the foam-like fixing liquid 1012 may be thinner than that in the case of FIG. 24B or 25B. However, in the case of FIG. 24A, the single layer of bubbles 1013 is formed. In this case, the bubbles 1013 are likely to be adhered to the application surface of the application roller 1011. Therefore, the foam-like fixing liquid 1012 may not be uniformly applied to the unfixed resin fine particles (unfixed toner) 1015 on the recording medium 1010 and as a result, the unfixed resin fine particles 1015 may be adhered to the bubbles 1013 and offset to the application surface of the application roller 1011 (toner offset).

On the other hand, FIG. 248 shows a case where a foam-like fixing liquid 1012 forming plural layers of bubbles 1013 is applied to the application surface of the application roller 1011. In this case, the bubbles 1013 may be easily adhered to the uneven surface of the unfixed resin fine particles 1015; the foam-like fixing liquid 1012 forming a layer of bubbles 1013 are likely to be separated from each other; and the foam-like fixing liquid 1012 may be uniformly applied to the toner layer on the recording medium 1010. Therefore, it becomes possible to reliably prevent the toner offset.

Because of the feature, in the case where a relatively high pressure is applied on the contact surface between the application roller 1011 and the recording medium 1010, it may become possible to reliably prevent the toner offset in which the unfixed resin fine particles 1015 are adhered to the application surface of the application roller 1011, by measuring the average size of the bubbles 1013 in advance and controlling the film thickness of the layer of the foam-like fixing liquid 1012 formed on the application surface of the application roller 1011 so that the film thickness of the layer of the foam-like fixing liquid 1012 is equal to plural times of the thickness of a single layer of the bubbles 1013.

Next, the case is described where the relatively low pressure is applied on the contact surface between the application roller 1011 and the recording medium 1010. FIG. 25A shows a case where a foam-like fixing liquid 1012 forming a single layer of bubbles 1013 is applied to the application surface of the application roller 1011. In this case, the bubbles 1013 may be easily adhered to the uneven surface of the unfixed toner 1015; a layer of bubbles is likely to be separated from the surface of the application roller 1011; and the foam-like fixing liquid 1012 may be applied to the surface of the unfixed toner 1015.

On the other hand, FIG. 25B shows a case where the foam-like fixing liquid 1012 forming plural layers of bubbles 1013 is applied to the application surface of the application roller 1011. In this case, the bubbles 1013 are more likely to bind to each other. Therefore, the bubbles 1013 are likely to remain on the surface of the application roller 1011. Unfortunately, the unfixed toner 1015 may be adhered to the bubbles 1013 and as a result, adhered (offset) to the surface of the application roller 1011.

Therefore, the toner offset in a case where a relatively low pressure is applied on the contact surface between the application roller 1011 and the recording medium 1010 (under a low-pressure condition) may be reliably prevented by measuring the average size of the bubbles 1013 in advance and controlling the film thickness of the layer of the foam-like fixing liquid 1012 formed on the application surface of the application roller 1011 so that the film thickness of the layer of the foam-like fixing liquid 1012 is equal to the thickness of a single layer of the bubbles 1013. However, when the thickness of the layer of the bubbles 1013 on the application surface of the application roller 1011 is too thick, the bubbles 1013 are likely to move in the area between the application roller 1011 and the recording medium 1010, thereby causing the accompanying movement of the toner particles. As a result, the image may be moved. Therefore, it is preferable to adequately control the film thickness of the layer of the foam-like fixing liquid 1012 so that the toner offset and the movement of the image can be prevented.

As described above, by controlling the film thickness of the layer of the foam-like fixing liquid in accordance with the size of the bubbles included in the foam-like fixing liquid and the applied pressure, it may become possible to prevent the toner offset to contact application means such as the application roller and the movement of the image and fix the unfixed resin fine particles (unfixed toner) to the recording medium with a small amount of application of the foam-like fixing liquid.

Namely, according to an embodiment of the present invention, a method is provided in which resin fine particles on a recording medium are fixed to the recording medium by applying a fixing liquid to the resin fine particles by using contact application means, the resin fine particles having been softened with a softener for dissolving or swelling at least a part of the resin fine particles. In this case, the fixing liquid is in foam form including bubbles when the fixing liquid is applied to and in contact with the resin fine particles. Further, by controlling the film thickness of the layer of the fixing liquid in accordance with the applied pressure, it may become possible to prevent the toner offset to contact application means such as the application roller and the movement of the image and fix the unfixed resin fine particles (unfixed toner) to the recording medium with a small amount of application of the fixing liquid. Further, the method may be effective for resin fine particles such as toner fine particles used in an electrophotographic technique. Further, by controlling the film thickness of the layer of the foam-like fixing liquid in accordance with the film thickness of the layer of the resin fine particles, it may become possible to prevent toner offset and the movement of the image.

The present application is based on and claims the benefit of priority of Japanese Patent Application Nos. 2007-320952, filed on Dec. 12, 2007 and 2008-229693, filed on Sep. 8, 2008, the entire contents of which are hereby incorporated herein by reference.

The invention claimed is:

1. An image forming apparatus in which foam bubbles are formed by at least one of a liquid and a gel, the image forming apparatus comprising:

an image forming unit forming an image on a recording medium; and a foam application unit applying some of the foam bubbles to the recording medium or an intermediate member for applying to the recording medium, the foam application unit comprising:

a foam forming unit forming the foam bubbles;

an application unit applying some of the foam bubbles to the recording medium or the intermediate member; and a supplying unit introducing the foam bubbles from the foam forming unit and supplying said some of the foam bubbles to the application unit through a supply opening, wherein the supplying unit includes a discharge opening through which others of the foam bubbles not to be supplied to the application unit are discharged, and an amount of the foam bubbles introduced from the foam forming unit to the supplying unit is greater than an amount of said some of the foam bubbles supplied to the application unit, wherein the discharge opening is disposed beyond an end, and outside an extent of the supply opening in a longitudinal direction of the supply opening, said longitudinal direction being orthogonal to a direction in which said some of the foam bubbles are applied to the recording medium or the intermediate member.

2. The image forming apparatus according to claim 1, wherein a fluid resistance of the foam bubbles at the discharge opening on the supplying unit when the foam bubbles are being discharged is greater than a fluid resistance of the foam bubbles at the supply opening on the supplying unit when the foam bubbles are being supplied.

3. The image forming apparatus according to claim 1, further comprising:

a unit for varying a fluid resistance of the foam bubbles at the discharge opening on the supplying unit when the foam bubbles are being discharged.

4. The image forming apparatus according to claim 1, further comprising:

a unit for varying a fluid resistance of the foam bubbles at the supply opening on the supplying unit when the foam bubbles are being supplied.

5. The image forming apparatus according to claim 1, wherein the discharge opening is positioned lower than the supply opening.

6. An image forming apparatus in which foam bubbles formed by at least one of a liquid and a gel are applied, the image forming apparatus comprising:

an image forming unit forming an image on a recording medium; and a foam application unit applying some foam bubbles to the recording medium or an intermediate member for applying to the recording medium, the foam application unit comprising:

a reservoir unit storing foam bubbles received from a foam forming unit and supplying said some foam bubbles through a supply opening;

an application unit receiving said some foam bubbles through the supply opening of the reservoir unit and applying said some foam bubbles;

a channel collecting extra foam bubbles remaining and not to be applied; and a heat unit heating the extra foam bubbles on the channel to return the extra foam bubbles to a liquid form, wherein the reservoir unit includes a discharge opening through which said extra foam bubbles remaining and not to be applied are discharged to the channel, and the discharge opening is disposed beyond an end, and outside an extent, of the supply opening in a longitudinal direction of the supply opening, said longitudinal direction being orthogonal to a direction in which said some foam bubbles are applied to the recording medium or the intermediate member.

7. The image forming apparatus according to claim 6, wherein the heat unit performs in first-mode or second-mode operations in which the heat unit heats the extra foam bubbles in the first-mode operation and the heat unit does not heat the extra foam bubbles in the second-mode operation.

8. The image forming apparatus according to claim 6, further comprising:

a foam forming unit forming the foam bubbles out of the treatment liquid; and a treatment liquid container containing the treatment liquid to be supplied to the foam forming unit, or a waste liquid container; wherein the channel is in communication with the foam forming unit and the treatment liquid container or the waste liquid container.

9. The image forming apparatus according to claim 6, wherein the heating unit includes plural surfaces each in contact with the extra foam bubbles.

10. The image forming apparatus according to claim 6, wherein the extra foam bubbles refer to the foam bubbles that have not been supplied to the application unit.

11. A foam application device applying foam bubbles prepared by foaming at least one of a fluid and a gel, the foam application device comprising:

a foam forming unit forming the foam bubbles;

an application unit applying some of the foam bubbles to a target application member; and a supplying unit introducing the foam bubbles from the foam forming unit and supplying said some of the foam bubbles to the application unit through a supply opening, wherein the supplying unit includes a discharge opening through which others of the foam bubbles not to be supplied to the application unit are discharged, and an amount of the foam bubbles introduced from the foam forming unit to the supplying unit is greater than an amount of said some of the foam bubbles supplied to the application unit, wherein the discharge opening is disposed beyond an end, and outside an extent, of the supply opening in a longitudinal direction of the supply opening, said longitudinal direction being orthogonal to a direction in which said some of the foam bubbles are applied to the recording medium or the intermediate member.

12. The foam application device according to claim 11, further comprising:

a channel collecting extra foam bubbles remaining without having been applied; and a heat unit heating the extra foam bubbles on the channel to return the extra foam bubbles to a liquid form.

* * * * *